United States Patent [19]

Ogle

[11] Patent Number: 4,628,423

[45] Date of Patent: Dec. 9, 1986

[54] TWIST ON REFLECTOR FOR INDUSTRIAL LIGHT FIXTURE

[75] Inventor: William D. Ogle, Syracuse, N.Y.

[73] Assignee: Cooper Industries, Inc., Houston, Tex.

[21] Appl. No.: 778,592

[22] Filed: Sep. 20, 1985

[51] Int. Cl.[4] ..... F21V 7/00

[52] U.S. Cl. ..... 362/341; 362/296; 362/368

[58] Field of Search ..... 362/296, 368, 363, 341, 362/226, 35

[56] References Cited

U.S. PATENT DOCUMENTS

| | | | |
|---|---|---|---|
| 2,710,340 | 6/1955 | Wince | 362/296 |
| 3,191,021 | 6/1965 | Berry et al. | 362/363 |
| 3,838,269 | 9/1974 | Bogdanous | 362/341 |

*Primary Examiner*—E. Rollins Cross

*Attorney, Agent, or Firm*—Eddie E. Scott; Alan R. Thiele

[57] ABSTRACT

A light fixture including a fixture housing and a detachable reflector is provided with an arrangement of a cylindrical rim portion of the housing having circumferentially spaced radially outwardly projecting sets of lobes or projections which form grooves for receiving cooperating radially inwardly disposed projections on the reflector whereby the reflector may be twisted on and off of the fixture housing. The lobes on the housing are spaced apart and provided with opposed abutment surfaces which are engaged by the edges of the projections on the reflector with respect to the housing. One of the abutments includes an inclined surface whereby forcible elastic deflection of the reflector projections permits disassembly of the reflector from the housing at will. The reflector and the housing are provided with indicia to facilitate alignment, assembly and diassembly of the reflector with respect to the housing.

16 Claims, 7 Drawing Figures

TWIST ON REFLECTOR FOR INDUSTRIAL LIGHT FIXTURE

BACKGROUND OF THE INVENTION

1. Field of the Invention

The present invention pertains to a light fixture having a lamp socket support housing provided with an adaptor to receive a lamp reflector mounted on the adaptor by interlocking tabs which permit twist on and off attachment and detachment of the reflector with respect to the housing.

2. Background

Various types of so called industrial or commercial lighting fixtures are known which are generally characterized by a support housing for a lamp socket which housing may also enclose electrical components such as ballast and starter elements. The fixtures typically also include a reflector attached to the housing by certain types of mechanical fasteners such as conventional threaded screws or the like. The operating environment and location of many applications of commercial lighting fixtures is such that access to the fixture for removal of the reflector for repair or replacement is difficult and often requires that the service worker be standing on a ladder or otherwise in a difficult position to work. In this regard the problems associated with putting the reflector in a position to be attached with conventional fasteners are particularly aggravated and place the worker in a hazardous situation or at least make it difficult to hold the reflector with one hand while attaching it with the other. Moreover, the operating environment of many industrial lighting fixtures is such that the fixtures are subject to vibration, high wind loads, ice accumulation and other factors which require that the reflector be firmly attached to the housing.

Although certain components of industrial lighting fixtures such as globes and lenses as well as lens guards have been developed which are adapted to be twisted on and off the support housing, as evidenced by the inventions in U.S. Pat. Nos. 3,191,021 and 3,383,269 assigned to the assignee of the present invention, the forces to which a relatively large, lightweight structure such as a reflector are subjected due to wind loads and the like require a substantially positive locking connection between the reflector and its support structure. It is to this end that the present invention has been developed with a view to providing a reflector connection to a support housing of an industrial lighting fixture and the like which overcomes the problems associated with prior art type reflector attachments.

SUMMARY OF THE INVENTION

The present invention provides a unique arrangement of a support housing for an industrial type lighting fixture and a reflector which is attached to the housing by interlocking peripheral tabs or projections on the reflector and cooperating receiving slot means formed on the housing whereby the reflector may be attached to or detached from the housing by a generally rotational or twisting movement.

In accordance with one aspect of the present invention there is provided an industrial lighting fixture including a reflector member having a generally cylindrical opening formed in the central portion of the member and a plurality of circumferentially spaced radially inward extending projections which are cooperable with means on the fixture housing forming receiving slots for the projections whereby the reflector may be mounted on and removed from the housing by rotational motion to insert the projections in the slots. The arrangement of projections and a plurality of radially outwardly projecting tabs formed on the housing and defining the projection receiving slots provides a unique manner of mounting the reflector on the housing wherein the reflector may be easily placed in position to be supported by the housing and, through a partial circular movement of the reflector relative to the housing, may become secured on and locked relative to the housing.

In accordance with still another aspect of the present invention there is provided a light fixture having a support housing and a detachable reflector both of which are constructed such that the reflector may be mounted on and secured in a locked position on the housing by placing the reflector adjacent to a series of circumferentially spaced support and locking tabs on the housing. The reflector may be partially rotated to a locked position on the housing and may be removed from the housing by a forcible rotational movement of the reflector in the opposite direction. In this regard the housing is provided with a plurality of tabs which form a slot for receiving a series of projections on the reflector. At least one of the tabs is provided with an inclined surface for engagement with an edge of the reflector projections so that the projections may exit from the slot upon being rotated in a direction opposite to that which resulted in the mounting and support of the reflector on the housing.

In accordance with still a further aspect of the present invention there is provided a light fixture having a reflector support housing or housing adaptor member including a plurality of circumferentially spaced apart radially projecting support tabs comprising a first series of tabs arranged generally coplanar with each other and spaced apart such as to receive and support a relatively thin bladelike projection on the reflector member. The first set of tabs include opposed end tabs which are configured to engage the opposite ends of the reflector projection to limit the rotation of the reflector in one direction and to provide for somewhat axial displacement of the reflector projection in the opposite direction upon efforts to move the reflector in a circular manner whereby the reflector projections may exit from the receiving slots. The housing or adaptor member is also provided with a second set of tabs which are circumferentially and axially spaced from the first set to define the projection receiving slots. At least one tab of each group of tabs of the second set has an inclined ramp for receiving the reflector projection whereby the projection is guided into the slot in locking engagement with the tabs forming the slot.

In accordance with still a further important aspect of the present invention a light fixture is provided having a combination of a housing adaptor and an improved reflector attachment which may be retrofitted to existing light fixtures and providing for the twist on and off and locking engagement of the reflector with respect to the housing and adaptor member.

Those skilled in the art will further appreciate the above described advantages and superior features of the present invention as well as additional aspects thereof upon reading the detailed description which follows in conjunction with the drawing.

DESCRIPTION OF THE PREFERRED EMBODIMENT

Figure 1:
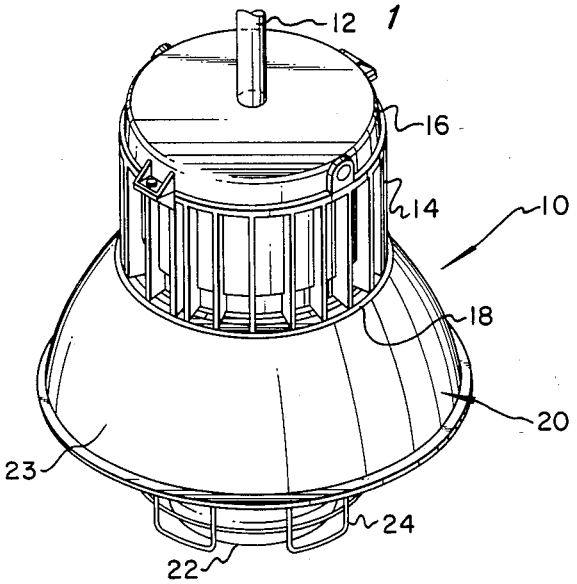
FIG. 1 is a perspective view of an industrial lighting fixture having the improved reflector-housing connection means of the present invention.

In the description which follows like parts are marked throughout the specification and drawing with the same reference numerals, respectively. The drawing figures are not necessarily to scale and certain features of the invention may be shown exaggerated in scale in the interest of clarity.

Figure 2:
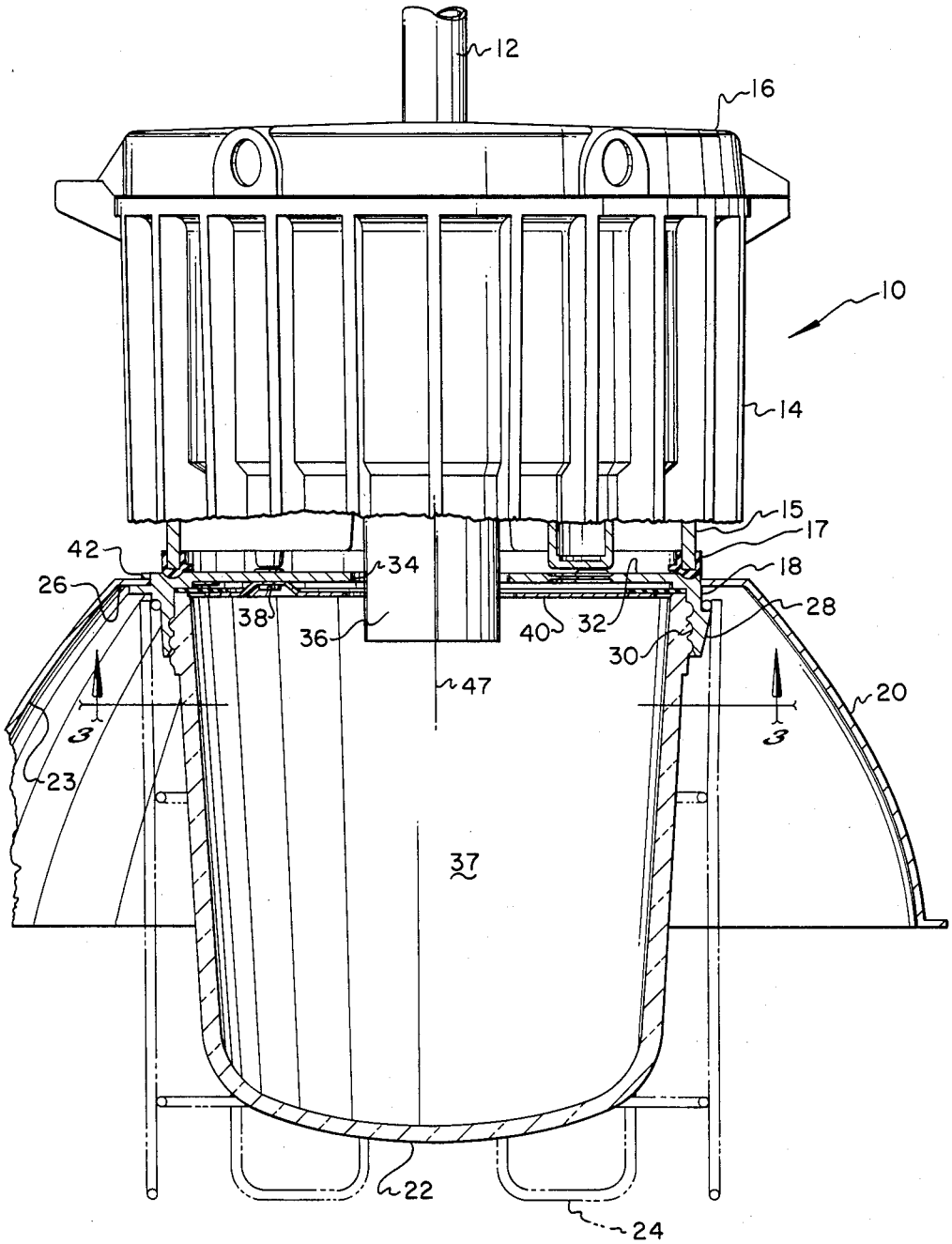
FIG. 2 is an elevation, partially in section, of a light fixture in accordance with the present invention.

Referring to FIGS. 1 and 2, there is illustrated an industrial type heavy duty light fixture in accordance with the present invention and generally designated by the numeral 10. The light fixture 10 is of a type which may be supported in various ways from, for example, a depending ceiling supported member 12 or, in accordance with modifications thereto supported by a stanchion, a vertical wall or a flexible pendant. The light fixture 10 is of a type suited for indoor as well as outdoor applications and may be subject to relatively high wind loads and the vibration induced thereby or to mechanical induced loads from nearby machinery or industrial processes. The light fixture 10 is generally characterized by a durable metal housing 14 having a top cover 16 and a depending adaptor member 18. The adaptor 18 is configured in a unique manner to support a relatively thin drawn or spun metal reflector, generally designated by the numeral 20. A depending glass globe or lens 22 is threadedly connected to the adaptor and an open bottom guard 24 is also disposed on the fixture 10 and supported by the adaptor 18 in a conventional manner.

The reflector 20 is configured as a generally bowl shaped so called "high bay" reflector having a generally oval bowl portion 23 and a transverse mounting flange portion 26. The basic configuration of the reflector 18 may be modified to redirect light in preselected directions emitted by a lamp, not shown, within the globe 22.

Referring now primarily to FIG. 2, a portion of the housing 14 is illustrated broken away to show details of the adaptor 18. The adapto 18 includes a generally cylindrical rim portion 28 which is provided with internal threads 30 for threadedly receiving the open end of the globe 22. The adaptor 18 is also provided with a generally planar web portion 32 having an opening 34 therein through which a conventional lamp socket 36 projects into an interior space 37 delimited by the globe 22. The housing 14 is also provided with a depending circumferential rim portion 15 which supports a resilient gasket 17 for engagement with the web 32 of the adaptor 18. The adaptor 18 is typically secured to the housing 14 by a plurality of threaded fasteners 38, one shown in FIG. 2, which also are operable to secure a reflector plate 40.

Figure 3:
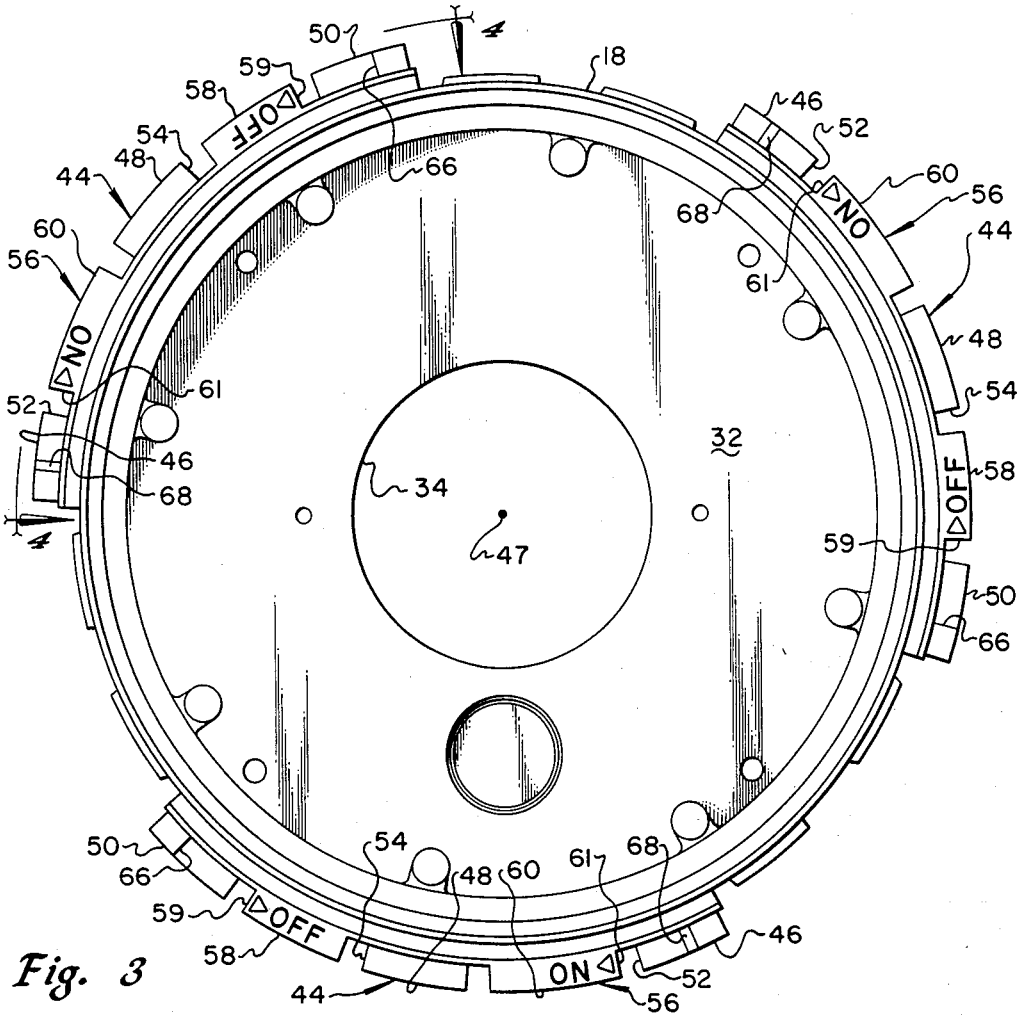
FIG. 3 is a plan view taken generally from the Line 3—3 of FIG. 2, of the fixture housing or adaptor showing the arrangement of the reflector receiving and supporting tabs.
Figure 4:
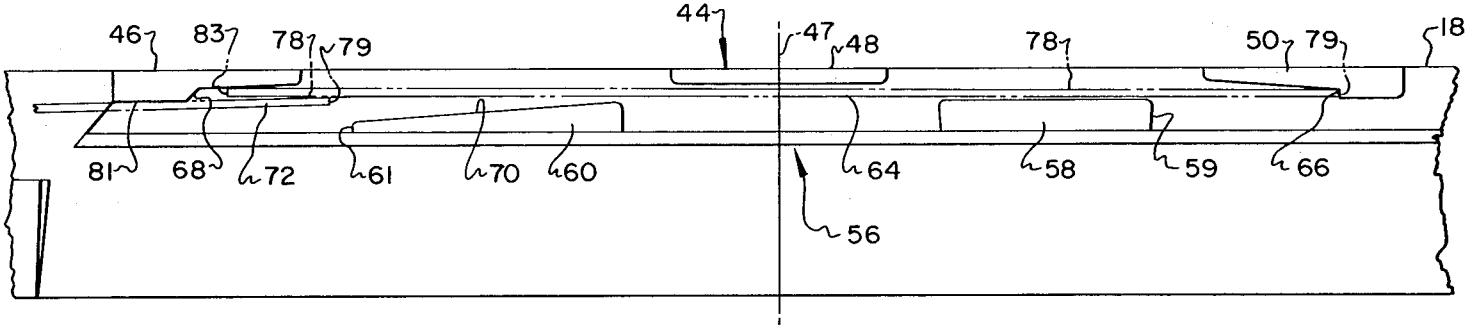
FIG. 4 is a developed side elevation taken generally from the line 4—4 of FIG. 3, showing one set of tabs from the housing shown in FIG. 3.

Referring also to FIGS. 3 and 4, the housing adaptor 18 is characterized by a circumferential cylindrical outer surface 42 at the junction between the rim 28 and the web 32 from which surface project three equally spaced apart flange segments 44. The flange segments 44 also include three equally spaced apart radially outwardly extending projections or lobes 46, 48 and 50 between which are formed respective recesses 52 and 54. A second set of flange segments is provided axially spaced from the flange segments 44 with respect to the longitudinal central axis 47 of the adaptor. The axis 47 is also essentially the axis of rotation of the reflector 20 when it is being mounted on or demounted from the adaptor 18. The second set of flange segments are designated by the numerals 56 and are provided with two circumferentially spaced tabs or lobes 58 and 60. The lobes 58 and 60 are circumferentially aligned with the recesses 52 and 54 and are of a circumferential length less than the length of the recesses themselves. The particular configuration of the projections or lobes 46, 48, 50, 58 and 60 is adapted to permit casting the adaptor 18 of metal or plastic, for example.

Referring particularly to FIG. 4 the axial spacing of the lobes 58 and 60 from the lobes 46, 48 and 50 provides a generally arcuate slot or groove 64 which is delimited at one end by an abutment 66 forming a surface which is generally normal to the circumferential extent of the slot 64. The slot 64 is also delimited at the opposite end by a surface 68 which is inclined with respect to the axis 47 for a purpose to be described in further detail herein. As shown also in FIG. 4, the lobe 60 is provided with an inclined surface 70 which is inclined at a relatively steep angle with respect to the axis 47 and in the same general direction of incline as the surface 68. The inclined surface 70 relieves the thickness of the lobe 60 to provide an entryway 72 for receiving radial inward projections or tabs formed on the reflector 20 and which will now be described in conjunction with FIGS. 4 and 5.

Figure 5:
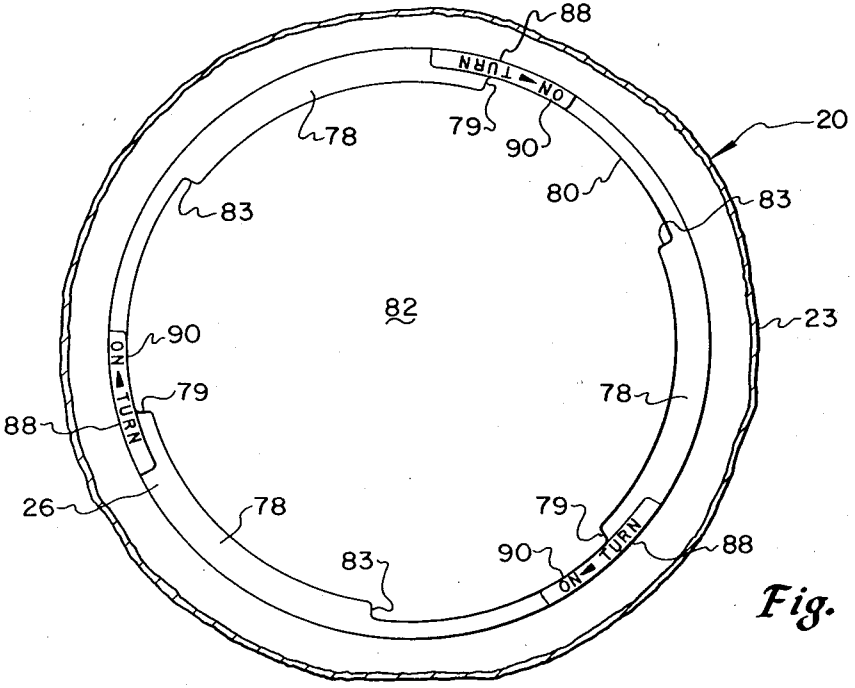
FIG. 5 is a plan view of the reflector showing the reflector support projections.

Looking at FIG. 5, in particular, the reflector 24 includes a plurality a radially inwardly extending arcuate projections 78 which project inwardly from a surface 80 defining an opening 82 in the center of the reflector flange 26. The circumferential length or extent of the projections 78 is at least slightly less than the circumferential or peripheral distance between a leading edge 61, FIGS. 3 and 4, of a lobe 60 of one set of lobes and a trailing edge 59 of a lobe 58 of an adjacent set of lobes. In this way a reflector 20 may be positioned with its projections 78 extending between adjacent sets of lobes on adaptor 18 and located by a surface 81 of the lobes 46 in preparation for a twisting or rotating movement of the reflector relative to the adaptor to insert the respective projections 78 into the respective grooves 64 formed between the respective sets of lobes.

Figure 6:
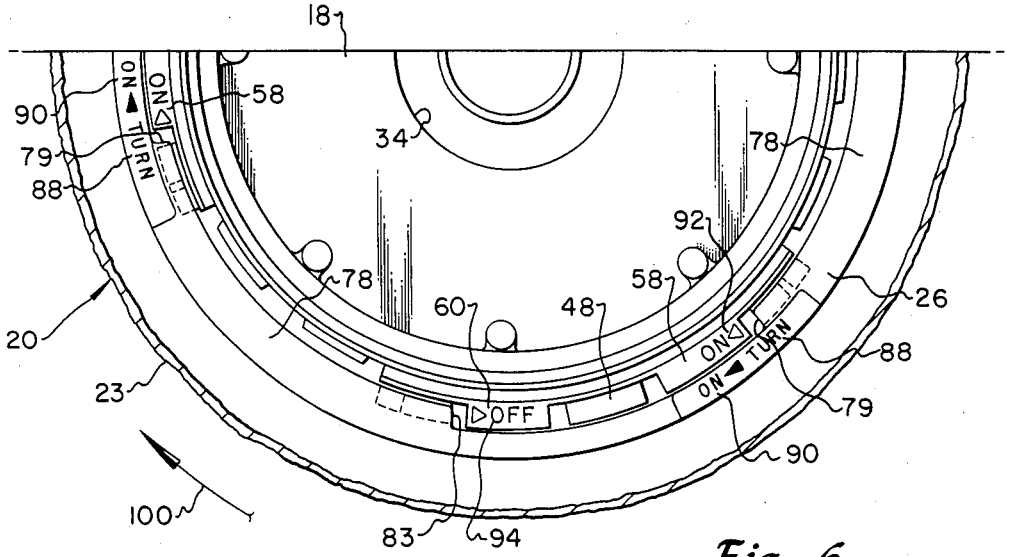
FIG. 6 is a view illustrating the reflector in place relative to the housing adaptor.
Figure 7:
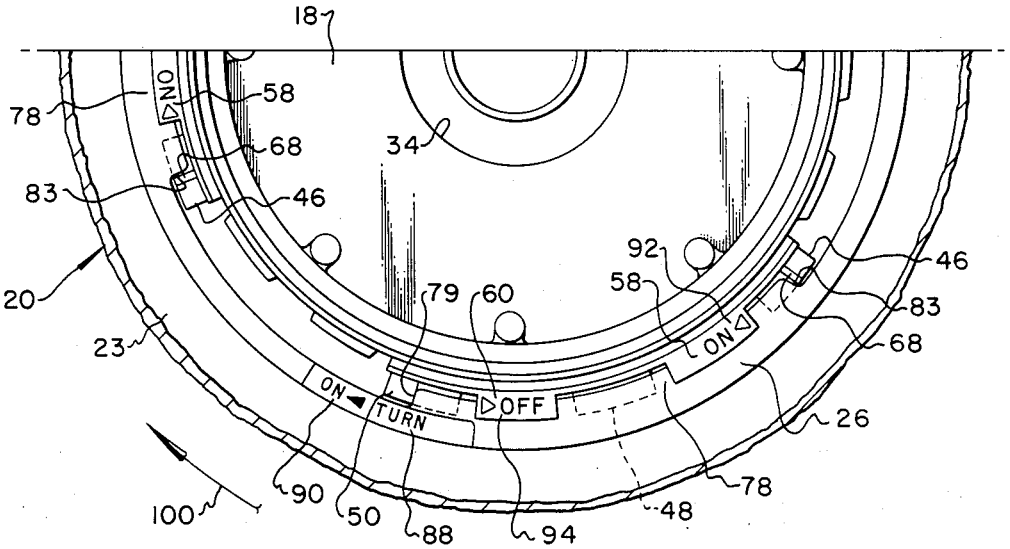
FIG. 7 is a view similar to FIG. 6 showing the location of the reflector relative to the adaptor after it has been rotated into the supported and locked position.

Referring now to FIGS. 4, 6 and 7, there is illustrated in FIGS. 6 and 7 the respective positions of a reflector 20 when it is placed in a position to be connected to the adaptor 18, FIG. 6, and the engaged and locked position, FIG. 7, respectively. As illustrated in FIGS. 6 and 7 the reflector 20 is preferably provided with suitable indicia 88 and 90 indicating the direction of rotation of the reflector relative to the adaptor 18 to mount the reflector on or take the reflector off of the adaptor. Moreover, the lobes 58 and 60 of the respective pairs of lobes are also provided with suitable indicia 92 and 94 cast or applied on the surface of the lobes and indicating the words "on" and "off", respectively, including associated directional arrows indicating which direction to rotate the reflector. By aligning at least approximately the indicia 90 on the reflector 20 with the correspondingly worded indicia 92 on the adaptor 18, as indicated in FIG. 6 and, by moving the reflector 20 upward or axially toward the surfaces 81 of the respective lobes 46, FIG. 4, until engaged therewith, the reflector is then in a position to be rotated in the direction of the arrow 100 in a clockwise manner, viewing FIG. 6 and 7, to move the respective projections 78 fully into the slots 64.

Referring also to FIG. 4, as the reflector 20 is rotated in the manner described above a leading edge 79 of each projection 78 engages the ramp surface 70 to elastically deflect the projections 78 into the grooves 64. The spacing of the lobes 48 and 50 with respect to the lobes 58 and 60 assures full support of the projections 78 as the reflector is rotated. Rotation of the reflector 20 continues until the leading edge 79 engages the abutment 66. Shortly prior to the engagement of the abutment 66 the trailing edge 83 of each projection 78 will pass the surface 68 and somewhat snap into the groove 64 so that the projections 78 return to a substantially planar undeflected condition. This is the position of the reflector 20 relative to the adaptor 18 illustrated in FIG. 7. In this condition the projections 78 are substantially locked in the recesses or grooves 64 and rotation of the reflector 20 relative to the adaptor 18 can only be accomplished with a direct and concerted effort in the direction opposite the arrow 100 in FIG. 7.

When it is desired to remove the reflector 20 from the light fixture 10 it is rotated counterclockwise, viewing FIGS. 6 and 7. The trailing edges 83 of the projections 78 engage the inclined surfaces 68 substantially simultaneously whereby the projections 78 may be elastically deflected in a downward direction, viewing FIG. 4, so that, as the reflector 20 is rotated, the projections 78 slide over the surfaces 81 until the reflector is rotated back to the position illustrated in FIG. 6 whereupon it can be removed from the adaptor 18. Only a relatively substantial and directed effort to rotate the reflector 20 in a counterclockwise direction, viewing FIGS. 6 and 7, results in movement of the projections 78 out of the grooves 64 in view of the requirement that the projections 78 be elastically deflected to accomplish this removal operation. Thanks to the relatively lightweight metal plate construction of the reflector 20 the projections 78 may be relatively easily deflected and an experienced installation person may accentuate the removal process by pulling on the reflector 20 in a slightly downward or axial direction relative to the axis 47 during the counter clockwise rotation process to facilitate removal of the projections 78 from the grooves in which they are disposed in the installed and locked position.

The particular arrangement of the lobes 58, 60, 46, 48 and 50 provides substantial support for the reflector projections 78 when they are disposed in the grooves 64. The location pattern of the respective sets of lobes may be such that, in combination with the particular pattern or spacing of the projections 78, the reflector can only be installed in one positional relationship relative to the housing 12. Moreover, thanks to the provision of the indicia on the reflector flange 26 and on the tabs or lobes 58 and 60 the direction of movement of the reflector 20 to place it on the adaptor 18 and remove it therefrom is clearly evident.

As pointed out previously herein the reflector 20 may be manufactured from lightweight steel or aluminum which is drawn or otherwise displaced to form the reflector shape and may be stamped or upset to form the central opening 82 and the associated projections 78. The adaptor 18 may be formed of cast or machined metal or plastic although the configuration of the lobes 46, 48, 50, 58 and 60 is particularly adapted for permanent mold or diecasting techniques.

Although a preferred embodiment of the invention has been described in detail herein those skilled in the art will recognize that various substitutions and modifications may be made to the specific structure described without departing from the scope and spirit of the invention as recited in the appended claims.

What is claimed is:

1. In a light fixture including a housing for supporting a lamp socket and the like, means associated with said housing forming a generally cylindrical rim and including spaced apart radially extending projections forming groove means;

a lamp reflector adapted to be mounted on said housing and including a flange portion having radially extending projections cooperable with said projections on said means associated with said housing in such a way that said reflector may be supported on said housing by aligning said projections on said reflector in a predetermined position relative to said projections on said means associated with said housing and rotating said reflector to move said projections on said reflector into said groove means; and means cooperable with said projections on said reflector for locking said reflector in said groove means and against unwanted movement relative to said housing.

2. The combination set forth in claim 1, wherein:

said projections on said means associated with said housing include opposed abutment surfaces spaced apart a circumferential distance at least slightly greater than the circumferential extent of a cooperating projection on said reflector and defining opposite ends of said groove means whereby said projection on said reflector may be disposed in said groove means and engageable with said abutment means to prevent unwanted movement of said reflector relative to said housing.

3. The combination set forth in claim 2, wherein:

said projections on said means associated with said housing comprise a set of first and second spaced apart projections including, respectively, said abutment surfaces delimiting the ends of said groove means and at least a third projection disposed between said first and second projections with respect to the circumference of said means associated with said housing and axially spaced from said first and second projections to define, in part, said groove means.

4. The combination set forth in claim 3 wherein:

at least one of said abutment surfaces includes an inclined surface for deflecting said projection on said reflector to provide for removal of said projection on said reflector from said groove means.

5. The combination set forth in claim 3, wherein:

said third projection includes an inclined surface for engagement with a leading edge of said projection on said reflector for deflecting said projection on said reflector into said groove means.

6. The combination set forth in claim 5, wherein:

said means associated with said housing includes a fourth projection interposed between said first and second projections, said third projection being disposed between said fourth projection and one of said first and second projections; and a fifth projection aligned axially with said third projection and spaced apart circumferentially relative to said third projection and between said fourth projection and the other of said first and second projections for supporting said projection on said reflector and for delimiting said groove means.

7. The combination set forth in claim 6, wherein:

said means associated with said housing includes plural sets of said first, second, third, fourth and fifth projections spaced apart circumferentially with respect to said cylindrical rim portion, and said reflector includes plural projections corresponding to the number of sets of projections on said means associated with said housing, said projections on said reflector having a circumferential extent slightly less than the circumferential spacing between an edge of said third projection of said one set and an opposite edge of said fifth projection of said other set.

8. The combination set forth in claim 6, wherein:

said first projection includes a surface engageable by said projection on said reflector for positioning said reflector axially relative to said means associated with said housing for rotation of said reflector to place said projections on said reflector in said groove means.

9. The combination set forth in claim 6 including:

indicia on said reflector and indicia on said means associated with said housing operable to provide for alignment of said projections on said means associated with said housing with corresponding recesses formed between said projections on said reflector and indicating the direction of rotation of said reflector relative to said housing for mounting or dismounting said reflector with respect to said housing.

10. In a light fixture including a housing for supporting a lamp socket and the like, an adaptor part for said housing forming a generally cylindrical rim and including spaced apart radially extending projections forming groove means;

a lamp reflector adapted to be mounted on said adaptor part and including a flange portion having circumferentially spaced apart radially inward extending projections cooperable with said projections on said adaptor part in such a way that said reflector may be mounted on said housing by aligning said projections on said reflector in a predetermined position relative to said projections on said adaptor part and rotating sid reflector to move said projections on said reflector into said groove means;

said projections on said adaptor part include opposed abutment surfaces spaced apart a circumferential distance at least slightly greater than the circumferential extent of a cooperating projection on said reflector and defining opposite ends of said groove means whereby said projections on said reflector may be disposed in said groove means and engageable with said abutment surfaces to prevent unwanted movement of said reflector relative to said housing; and at least one of said abutment surfaces includes an inclined surface portion for deflecting an edge of said projection on said reflector out of said groove means in response to forced rotation of said reflector relative to said adaptor part.

11. The combination set forth in claim 10, wherein:

said adaptor part includes an inclined surface for engagement with a leading edge of said projection on said reflector for deflecting said projection on said reflector into said groove means.

12. The combination set forth in claim 11, wherein:

said adaptor part includes plural sets of projections spaced apart circumferentially with respect to said cylindrical rim portion, and said reflector includes plural projections corresponding to the number of sets of projections on said adaptor part, said projections on said reflector having a circumferential extent slightly less than the circumferential spacing between an edge of an end projection of one set of projections on said adaptor part and an opposite edge of an opposite end projection of an adjacent set of projections on said adaptor part.

13. In a light fixture including a housing for supporting a lamp socket and the like, a part of said housing forming a generally cylindrical rim and including spaced apart radially extending projections;

a lamp reflector adapted to be mounted on said part and including a portion having at least one radially inward extending projection cooperable with said projections on said part in such a way that said reflector may be mounted on said housing by aligning said projection on said reflector in a predetermined position relative to said projections on said part and rotating said reflector to move said projection on said reflector into a position between said projections on said part;

said projections on said part include opposed abutment surfaces spaced apart a circumferential distance at least slightly greater than the circumferential extent of said projection on said reflector whereby said projection on said reflector may be engageable with said abutment means to prevent unwanted movement of said reflector relative to said housing; and said part includes means forming an inclined surface for engagement with a leading edge of said projection on said reflector for elastically deflecting said projection on said reflector when said reflector is rotated to move said projection on said reflector into said position between said projections on said part.

14. The combination set forth in claim 13, wherein:

at least one of said abutment surfaces includes an inclined surface portion for deflecting an edge of said projection on said reflector out of said groove means in response to forced rotation of said reflector relative to said adaptor part.

15. The combination set forth in claim 14, wherein:

said part includes plural sets of projections spaced apart circumferentially with respect to said cylindrical rim portion, and said reflector includes plural projections corresponding to the number of sets of projections on said part, said projections on said reflector having a circumferential extent slightly less than the circumferential spacing between an edge of an end projection of one set of projections on said part and an opposite edge of an opposite end projection of an adjacent set of projections on said part.

16. The combination set forth in claim 13, including: indicia on said reflector and indicia on said part cooperable to provide for alignment of said projections on said part with said reflector and indicating the direction of rotation of said reflector relative to said housing for mounting or dismounting said reflector with respect to said housing.

* * * * *